US006230757B1

(12) United States Patent
Lefever

(10) Patent No.: US 6,230,757 B1
(45) Date of Patent: May 15, 2001

(54) DEVICE FOR TENSIONING WARP THREADS IN A LOOM

(75) Inventor: Bart Lefever, Ypres (BE)

(73) Assignee: Picanol N.V. (BE)

( * ) Notice: Subject to any disclaimer, the term of this patent is extended or adjusted under 35 U.S.C. 154(b) by 0 days.

(21) Appl. No.: 09/424,237

(22) PCT Filed: May 22, 1998

(86) PCT No.: PCT/EP98/03036

§ 371 Date: Mar. 15, 2000

§ 102(e) Date: Mar. 15, 2000

(87) PCT Pub. No.: WO98/54386

PCT Pub. Date: Dec. 3, 1998

(30) Foreign Application Priority Data

May 28, 1997 (BE) ..... 9700466

(51) Int. Cl.[7] ..... D03D 49/12
(52) U.S. Cl. ..... 139/115; 139/110
(58) Field of Search ..... 139/110, 114, 139/115

(56) References Cited

U.S. PATENT DOCUMENTS

| | | | | |
|---|---|---|---|---|
| 4,240,471 | * | 12/1980 | Rotrekl et al. | 139/115 |
| 4,262,706 | * | 4/1981 | Popp et al. | 139/114 |
| 4,534,386 | * | 8/1985 | Pfarrwaller | 139/114 |
| 4,722,368 | * | 2/1988 | Pezzoli | 139/110 |
| 5,090,453 | * | 2/1992 | Stacher et al. | 139/115 |
| 5,305,802 | * | 4/1994 | Fehrenbach | 139/110 |
| 5,755,268 | * | 5/1998 | Arndt et al. | 139/115 |

* cited by examiner

*Primary Examiner*—Andy Falik
(74) *Attorney, Agent, or Firm*—Bacon & Thomas PLLC

(57) ABSTRACT

An apparatus for tensioning warp threads in a weaving machine having a rotatably mounted carrier beam (5) which exerts strain on a tensioning roll (10) acting on the warp threads (15). A pre-stressed torsion spring (16) is arranged inside the carrier beam (5) and via its torque, presses the tensioning roll (10) against the warp threads (15). The apparatus can sense the torsional moments of the torsion spring (16).

14 Claims, 7 Drawing Sheets

DEVICE FOR TENSIONING WARP THREADS IN A LOOM

BACKGROUND OF THE INVENTION

1. Field of the Invention

The invention relates to a warp thread tensioning apparatus used in a weaving machine and comprises a rotatably supported carrier beam acting a distance from its axis of rotation on a warp thread-tensioning device and loaded preferably with a prestressed torsion spring.

2. Description of the Related Art

Apparatus of the above kind is known from U.S. Pat. No. 4,534,386. This patent discloses that the warp tension can be determined by the angular position of the carrier beam and optionally may be used to regulate or control the warp thread letting off speed. In this patent, the angular position of the carrier beam is determined not only by the warp tension, thus the determination of warp tension is fairly inaccurate.

It is known from U.S. Pat. No. 5,029,619 to determine the warp tension from the force that is exerted by parts of the warp threads via a sensor. The measured force depends on the number of warp thread threads acting on the sensor. Therefore care must be made that the number of warp threads remain constant. Moreover this design includes the danger of the sensor damaging the warp threads.

SUMMARY OF THE INVENTION

The objective of the invention is to design an apparatus related to the initially cited type of art wherein the warp tension may be accurately determined, in particular for the purpose of adjusting the warp tension and/or to regulate or control the warp thread letting-off speed as a function of the warp tension, while being free of the danger of damage to the warp thread threads.

This problem is resolved by using sensors measuring the torques of the torsion spring.

The invention offers the advantage that the warp tension can be ascertained in a simple manner from the torques exerted by the torsion spring.

In a preferred embodiment of the invention, the end of the torsion spring is mounted inside the carrier beam and is supported in the beam by means of a bearing and further is connected to a device that cooperates essentially in the radial plane of the bearing with a stationary stop, and sensors for the torques of the torsion spring which may be integrated in the torsion spring.

This design offers the advantage that torques can be sensed which substantially correspond to the torques exerted by the warp threads through the tensioning device on the carrier beam. The torsion-spring torque differs from the torque exerted by the warp threads only by the amount of torque generated by the friction of the bearing between the carrier beam and the torsion spring. In the preferred embodiment wherein the stop is mounted in the region of the bearing, resulting friction is low because the bearing is practically free of bending torque. Furthermore the friction inside the bearing is low because the carrier beam and the torsion spring rotate relative to each other during weaving operations and accordingly the friction inside the bearing is a so-called dynamic friction that is relatively low.

In one embodiment of the invention the bearing is mounted in the carrier beam and the device according the invention is mounted around said carrier beam and is situated in a radial plane running perpendicularly to the carrier-beam axis in the region of the bearing.

Preferably the bearing diameter is small. This feature offers the advantage that, because of the small diameter, bearing friction forces will apply only a slight torque on the torsion spring and as a result the sensed torque present within the torsion spring will practically be the torque exerted by the warp threads on the carrier beam.

In a preferred embodiment the bearing is a needle bearing. Such a needle bearing has low friction. Because the carrier beam and the torsion spring rotate relative to each other during weaving operations, there is little danger that such a needle bearing will wear.

In another preferred embodiment, the device of the invention comprises a non-rotating element connected to the torsion spring and linked by an adjusting element to a transmission element resting against a stationary stop. This configuration, wherein the bearing is between the carrier beam and the torsion spring is free of a bending torque due to prestressing the torsion spring, allowing the friction to be kept low in this bearing.

In another preferred embodiment of the invention, the torsion springs are composed of several segments which are non-rotationally connected to each other and are mutually displaceable in the axial direction. Preferably the springs are connected to the carrier beam selectively in a non-rotational manner. This torsion spring composed of segments offers the advantage that no axial forces caused by torsion will arise. Furthermore the spring rigidity can be set by selecting the segments connected to the carrier beam.

BRIEF DESCRIPTION OF THE DRAWINGS

Further features and advantages of the invention will be evident in the following description of the illustrative embodiments shown in the drawing.

DETAILED DESCRIPTION OF THE PREFERRED EMBODIMENTS

Figure 1:
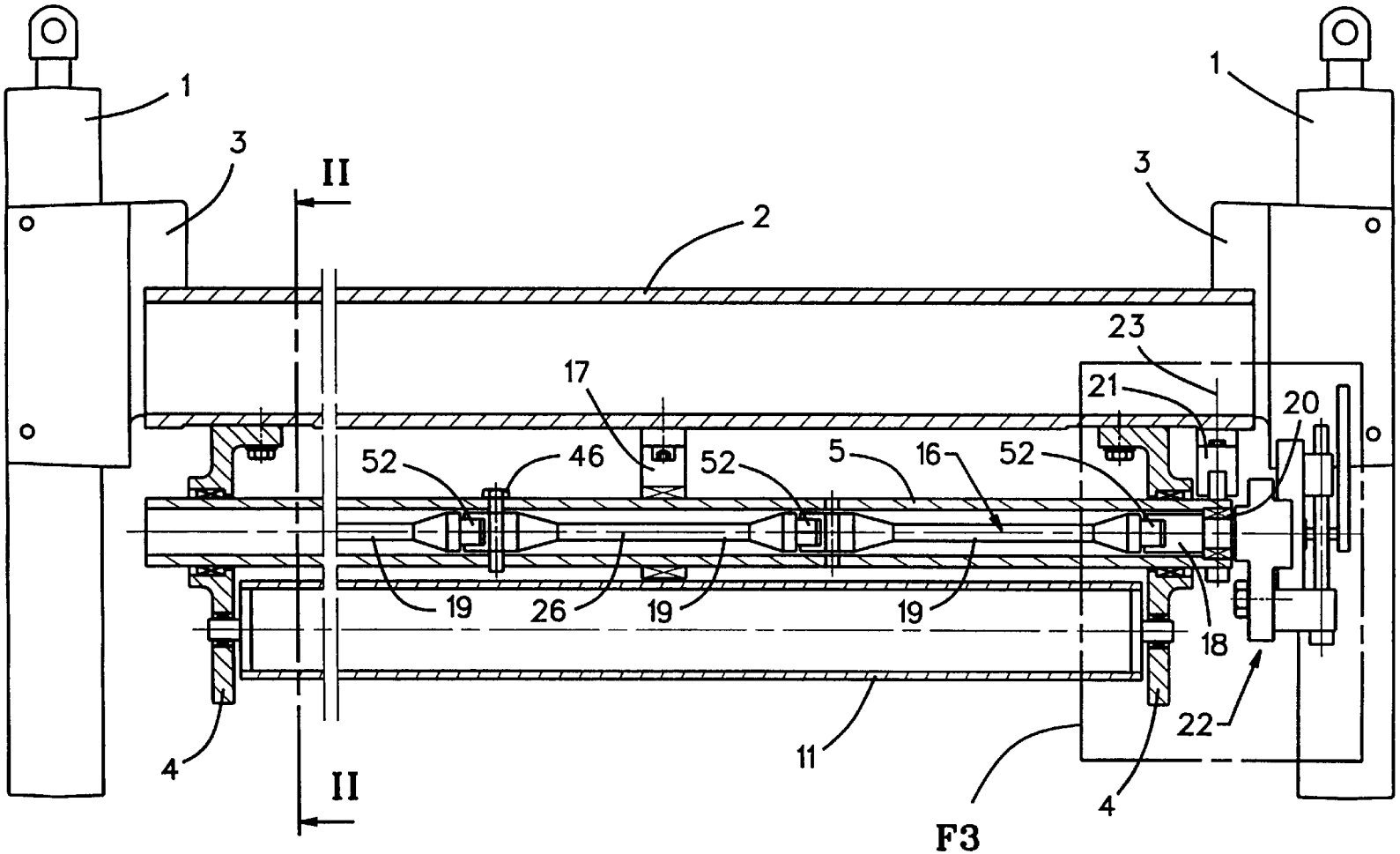
FIG. 1 is a schematic and partially sectional portion of a weaving machine configured with the apparatus of the invention.
Figure 2:
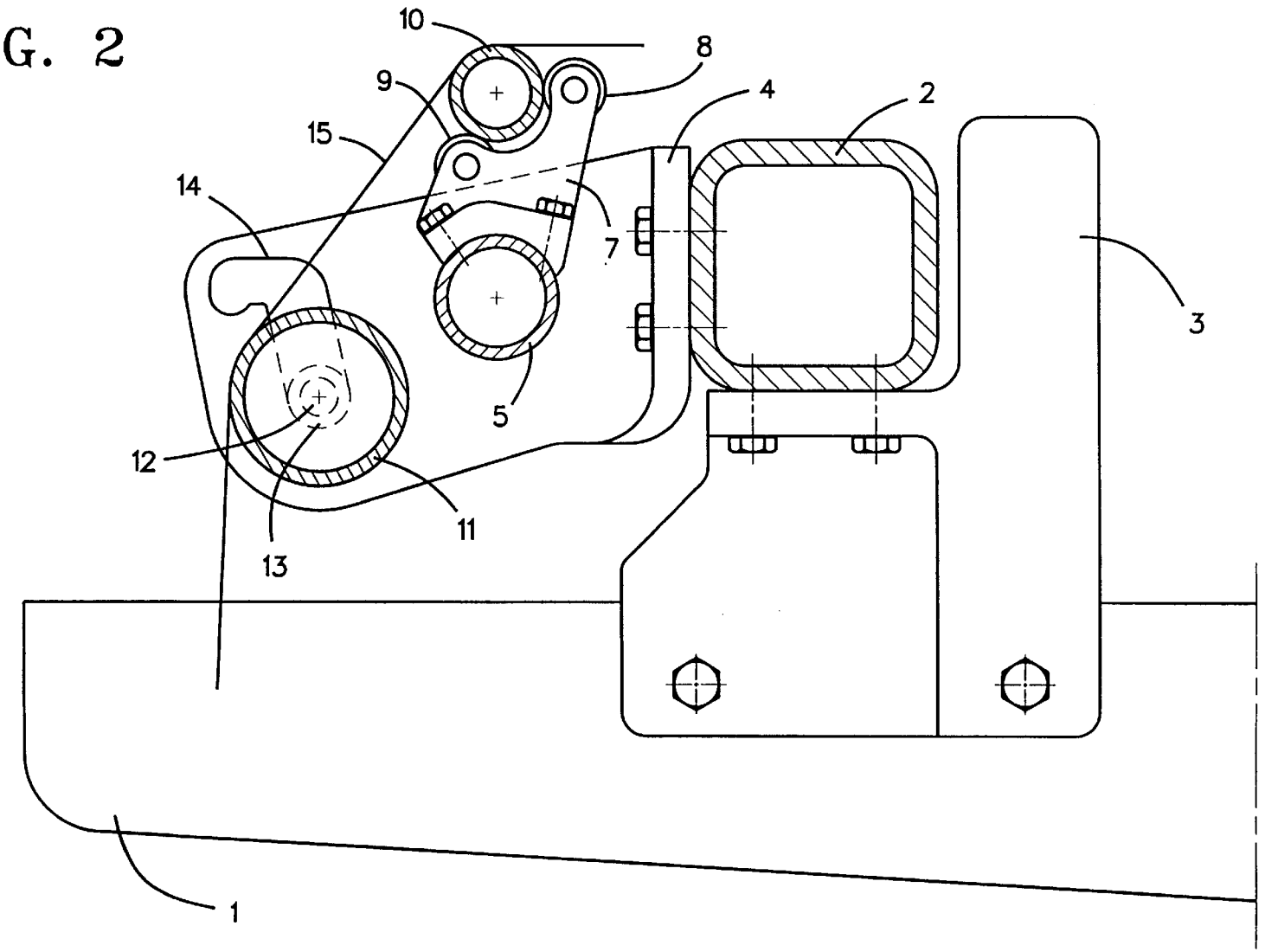
FIG. 2 is an exploded view of a section along line II—II of FIG. 1.
Figure 3:
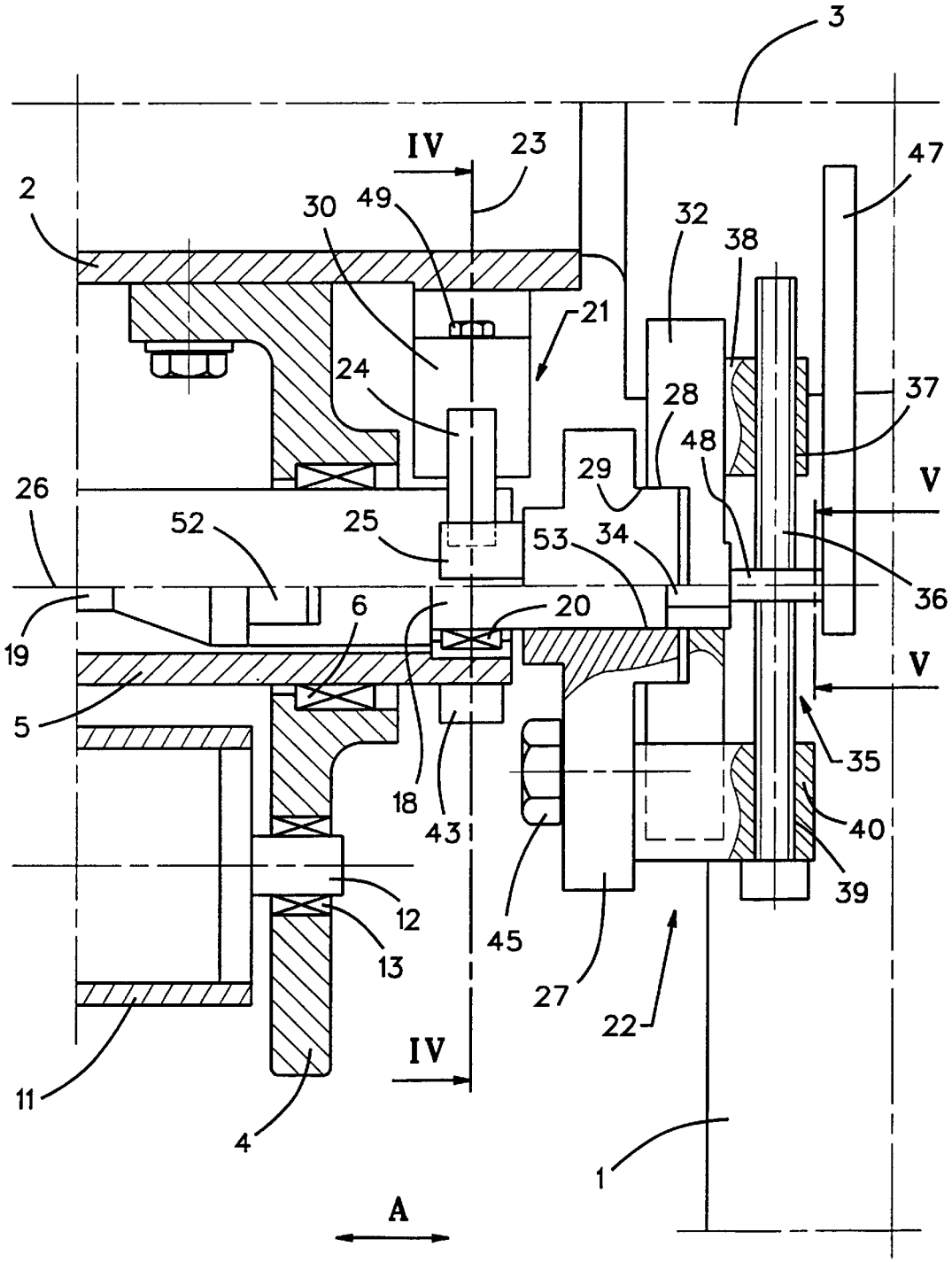
FIG. 3 is an exploded view of the cutaway F3 of FIG. 1.

Two support posts 1 which are part of the side frames of a weaving machine are shown in FIGS. 1 through 3. In the manner of U.S. Pat. No. 5,293,908, the support posts 1 may be height-adjustable in relation to their associated side frames. A carrier beam 2 is mounted between the support posts 1 and runs across the width of the weaving machine. The support posts 1 and the carrier beam 2 are connected to each other by fasteners 3. A retention device 4 is affixed to the carrier beam 2 in the vicinity of the support arm 1 and rotatably supports in each case, a carrier beam 5 in the form of a tube in a bearing 6. Retention device 7 fitted with rotatably supported rollers 8, 9 is mounted on the carrier beam 5. The rollers 8, 9 form bearings for a tensioning roll 10 over which run the warp threads 15. The carrier beam 5 is additionally supported and braced by a bearing in additional braces 17 that are mounted against the carrier beam 2. A torsion spring 16 is mounted inside the carrier beam 5 and via the beam 5 presses the tensioning roll 10 against the warp threads 15. In another embodiment, the carrier beam is held in place by several braces at the frame of the weaving machine in the manner disclosed in U.S. Pat. No. 4,534,386.

The torsion spring 16 includes of a coupling 18 and several segments 19 which are non-rotatably connected to each other while being mutually displaceable in the axial direction. The coupling 18 and the segments 19 are connected to each other by couplings 52 with hexagonal sockets and hexagonal bars, as a result of which the individual segments are non-rotatably coupled to each other while being relatively displaceable axially. The individual elements are mutually and axially displaceable and as a result, axial stresses generated by torsion applied to individual elements will not be transmitted. An end of each one of the segments 19 can be non-rotatably connected by a screw 46 to the carrier beam 5 in order to adjust the rigidity of the torsion spring 16. The effective length of the torsion spring 16 is determined depending on the particular segment non-rotatably connected to the carrier beam 5, and it is possible in this manner to adjust/match the rigidity of the torsion spring 16.

A reversing roller 11 is additionally mounted between the retention device 4. This reversing roller is fitted at each end with an axial journal 12 and a bearing 13. This bearing 13 is displaceable in a slot 14 to move the reversing roller 11 into a higher position, for instance when changing a warp thread beam. The warp threads 15 run over the reversing roller 11 and the tensioning roll 10.

Figure 4:
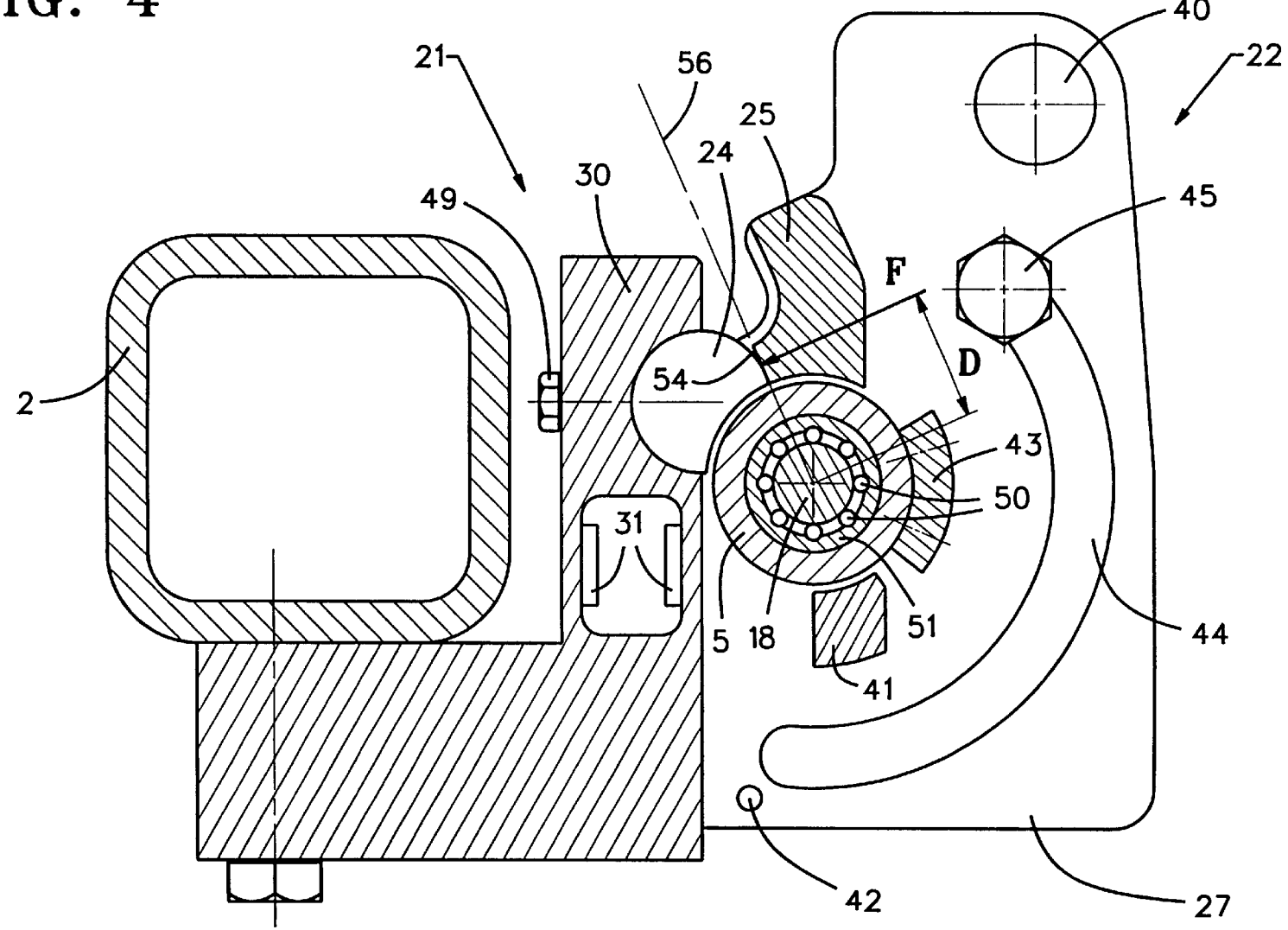
FIG. 4 is a section along line IV—IV of FIG. 3.
Figure 5:
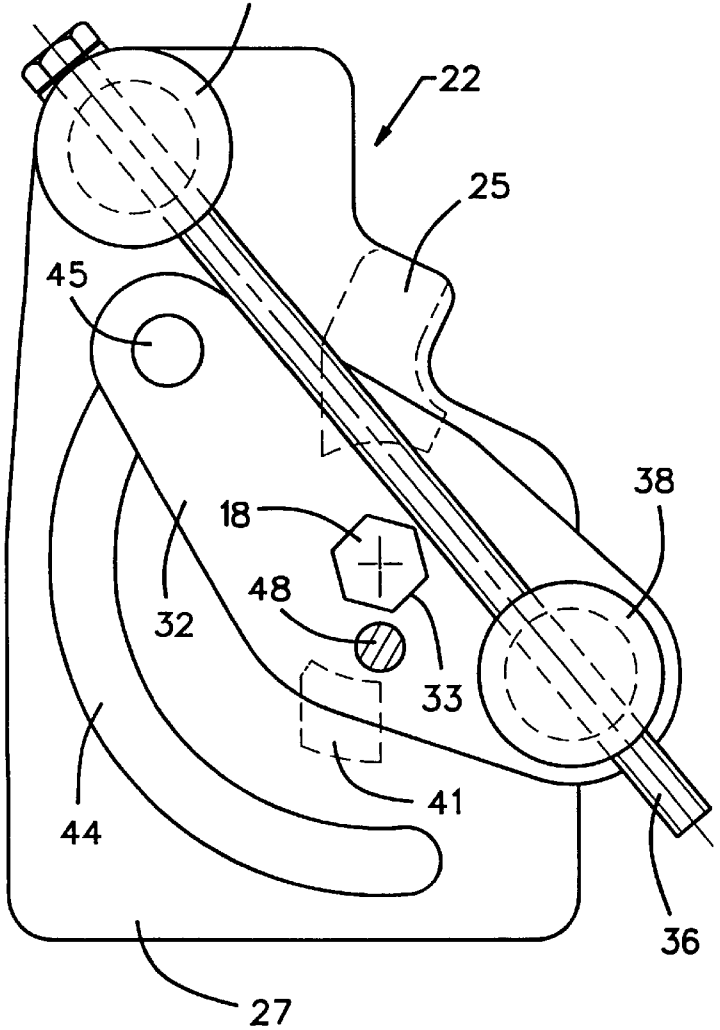
FIG. 5 is a section along line V—V of FIG. 3.

As shown by FIGS. 3 through 5, the coupling 18 of the torsion spring 16 rests on a bearing 20 in the end of the carrier beam 5. A force sensor 21 is mounted in the region of the bearing 20 as seen in the axial direction A of the carrier beam 5. The components of a measuring device 22 are mounted in this region, with the device being connected to the torsion springs 16. The components cooperate with the force sensor 21 to measure the force by which the torsion spring 16 acts on the force sensor 21. The components of the measuring device 22 are mounted around the carrier beam 5 and act on the force sensor 21.

In the embodiment shown, the force sensor 21 and the bearing 20 are mounted in a common radial plane 23 running perpendicularly to the axis 26 of the carrier beam 5. The bearing 20 moreover is mounted in the vicinity of the bearing 6 in the retention device 4 for the carrier beam 5. The force sensor 21 is affixed by support beam 2 to the frame of the weaving machine and as a result, the force sensor 21 and the electrical conductors leading to the force sensor 21 can be affixed in a rigid manner. The force sensor 21 includes a retention device 30 into which may be attached a measuring device, for instance measuring strips 31, said strips being connected in a known manner by leads to a test bridge. The test bridge is connected (in a manner not described further) to a weaving machine control unit whereby, for instance, the warp thread control motor can be regulated or controlled as a function of the detected warp thread tension. The retention device 30 is affixed to the carrier beam 2.

In another embodiment, the retention device 30 is affixed to the support post 1. The retention device 30 is fitted with a bracing element 24 mounted in the radial plane 23 and opposite the circumference of the carrier beam 5. The bracing element 24 cooperates with a stop 25 which is a component of the measuring device 22 which will be described further. The bracing element 24 is affixed by a screw 49 to the retention device 30. The stop 25 comes to rest at a precisely defined position against the bracing element 24 and as a result, the torque of the torsion spring 16 can be determined from the measured force F (FIG. 4). The stop surface of the bracing element 24 is partly cylindrical, whereas the stop 25 is fitted with an appropriate tangential, planar stop surface 54 located in a tangential plane 56 containing the axis 26 of the torsion spring 16. A line of contact between the bracing element 24 and the stop 25 is implemented in this way. The torque is determined by the product of the measured force F and the distance D between the axis 26 of the carrier beam 5 and the line of contact between the stop 25 and the bracing element 24.

The measuring device 22 contains an element 32 non-rotatably connected to the coupling 18 and hence also to the torsion spring 16. The element 32 is fitted with a hexagonal socket 33 set on a hexagonal bar 34 present at the coupling 18 of the torsion spring 16. Furthermore the measuring device 22 contains a transmission element 27 rotatably supported relative to the element 32. The transmission element 27 is fitted with an annular shoulder 29 mounted with slight play in a borehole 28 of the element 32. Preferably the transmission element 27 is also rotatably supported by a borehole 53 on the coupling 18 of the torsion spring 16. The stop 25 cooperates with the bracing element 24 and is a component of the transmission element 27.

Figure 6:
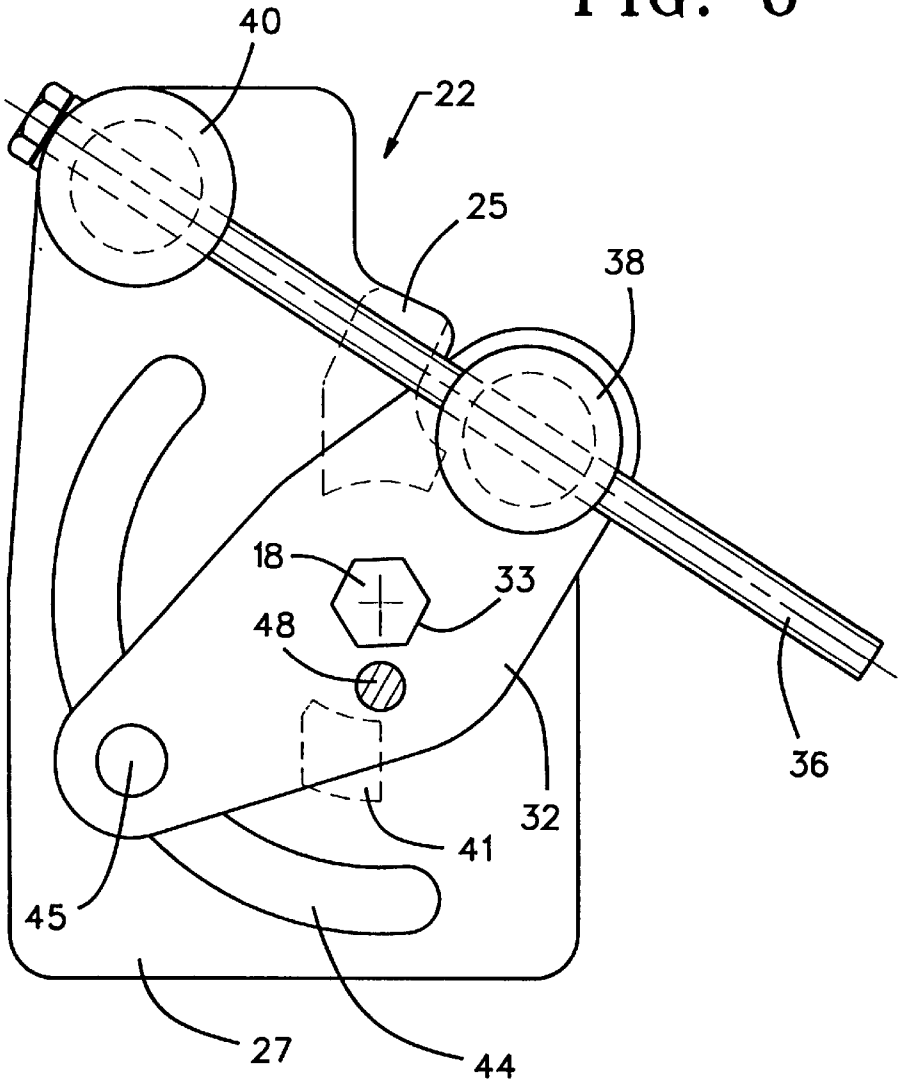
FIG. 6 is the section along the line V—V of FIG. 3 at another position.

Adjusting device 35 is provided to adjust the angular position between the transmission element 27 and the element 32. These adjusting device 35 contain a tensioning screw 36 engaging a thread 37 of an inset 38 rotatably mounted on the element 32. The tensioning screw 36 passes through a borehole 39 of an inset 40 rotatably mounted on the transmission element 27. The transmission element 27 and the element 32 can be non-rotatably affixed to each other by a screw 45. The screw 45 passes through a slot 44 of the transmission element 27 and engages a thread of the element 32. The particular position of the transmission element 27 and of the element 32 thus may be adjusted by rotating the tensioning screw 36 in the thread 37 provided the screw 45 has not been tightened. FIG. 6 shows the transmission element 27 and the element 32 in a different position than in FIG. 5.

The warp threads 15 exert a force during weaving operations on the tensioning roll 10 and this force applies a torque on the carrier beam 5. This torque opposes forces exerted by the torsion spring 16 on the carrier beam 5. The torque of the torsion spring 16 corresponds to the force F times the distance D at which the stop 25 of the transmission element 27 rests on the bracing element 24 of the force sensor 21. Because the tension in the warp threads 15 changes continuously on account of the motion of the harnesses and the beat-up of the warp threads, the force exerted by the warp threads 15 on the tensioning roll 10 also changes. Because the force sensor 21 is mounted substantially rigidly, the coupling 18 of the torsion spring 16 will not rotate during operation. Therefore the carrier beam 5 is configured to rock due to changes in the warp tension during weaving operations and hence the segments 19 of the torsion spring 16 are rotated along correspondingly. The torsion spring 16 may be adjusted and/or prestressed in such manner, by rotating the coupling 18 of the torsion spring 16, by adjusting the transmission element 27 and the element 32 of the measuring device 22, such that the tensioning roll 10 assumes a desired position at a mean warp tension. The rigidity of the torsion spring 16 can be adjusted by selecting the length of the effective operative segment of the torsion spring 16 as already discussed above.

When weaving is carried out at low warp tensions, the torsion spring 16 need not be prestressed, perhaps only requiring adjustment. In order for weaving machine adjustments to be as few as possible when changing a warp beam, the torsion spring 16 preferably will be pre-stressable in the absence of warp threads 15. For that purpose a second stop 41 is provided which cooperates with a stop 43 affixed to the carrier beam 5. The two stops 41 and 43 are mounted in the axial direction A of the carrier beam 5 in the region of the radial plane of the bearing 20 and the force sensor 21. When the warp threads 15 exert no force, or only a slight one, on the tensioning roll 10, and the torsion spring 16 is pre-stressed, the stop 43 of the carrier beam 5 will be forced against the second stop 41 by the torque exerted by the torsion spring 16. A desired pre-stressing of the torsion spring 16 can be achieved by adjusting the transmission element 27 and the element 32 to a pre-determined angular position. The force exerted when pre-stressing the torsion spring 16 is absorbed between the second stop 41 and the stop 43 of the carrier beam 5. Because these components are configured along the axial direction A of the carrier beam in the radial center plane 23 of the bearing 20, no bending torque shall be introduced into the bearing 20.

Figure 7:
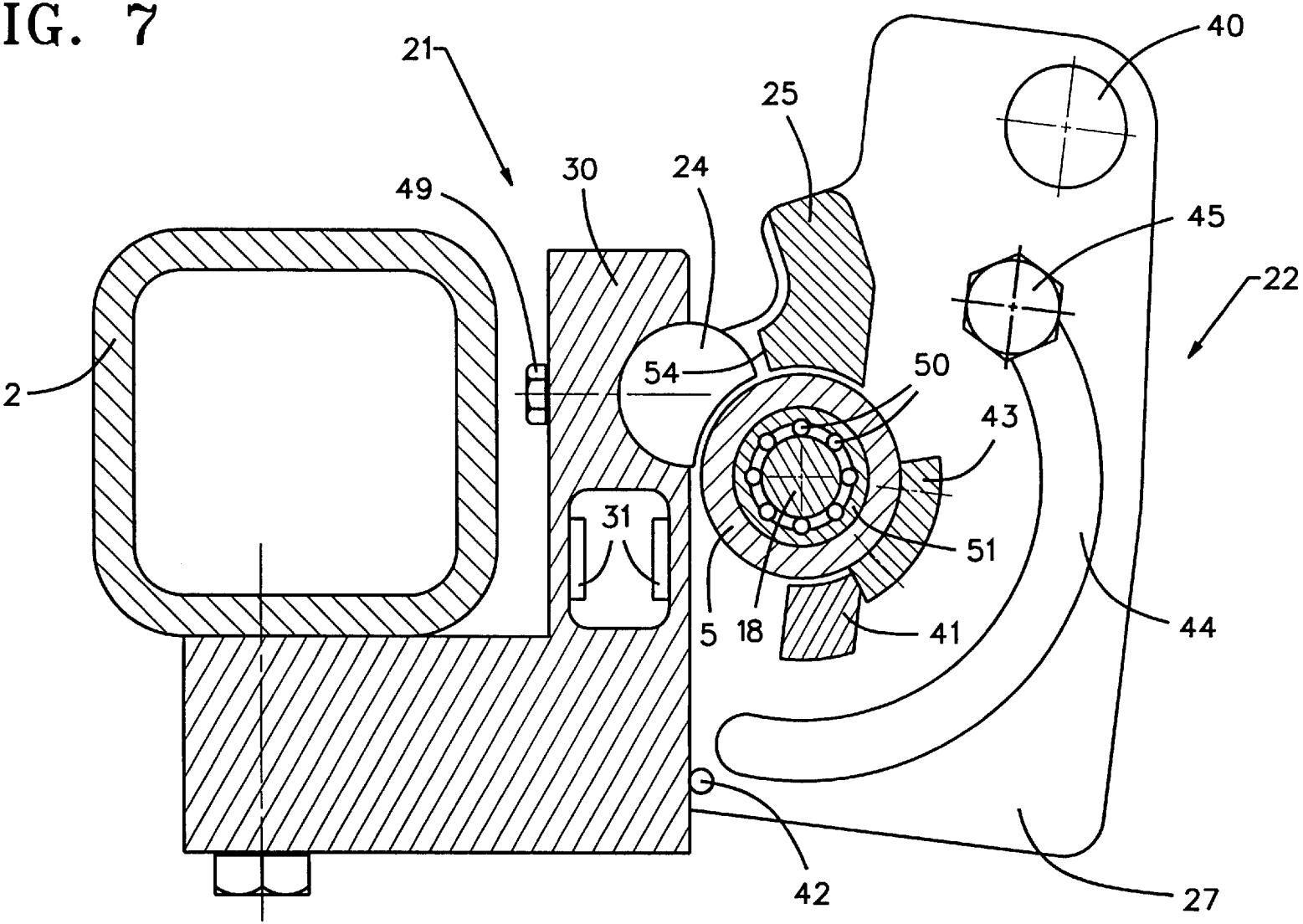
FIG. 7 is a section corresponding to FIG. 4 at another position.

The stop 41 is mounted on the transmission element 27 to implement the pre-stressing of the torsion spring 16 without the force sensor 21 being required to absorb the pre-stressing force. When pre-stressing in the absence of warp tension, the stop 43 of the carrier beam 5 will rest against the stop 41, whereby the carrier beam 5 together with the measuring device 22 can be rotated in the bearings 6 through an excursion limited by a stop 42. The stop 42 is affixed to the transmission element 27 and illustratively cooperates with the retention device 30. However this stop 42 also may cooperate with any other element of the weaving machine's frame. As shown in FIG. 7, in this process the stop 25 is separated from the bracing element 24 and as a result the force sensor 21 is unloaded. For that reason the neutral setting of the force sensor 21 also can be set in the case of a pre-stressed torsion spring 16.

When the warp tension re-exerts a torque through the tensioning roll 10 on the carrier beam 5, the stop 25 of the transmission element 27 comes to rest again on the bracing element 24 while the stop 42 separates from the retention device 30. When the torque is larger than that of the (possibly pre-stressed) torsion spring 16, the stop 43 separates from the stop 41 and the position of FIG. 4 is assumed again. To prevent overloading the torsion spring 16, the stop 43 also may cooperate with the stop 25. For appropriate operation of the tensioning roll 10 during weaving operations, the pre-stressing must be selected in such manner that, during weaving operations, the stop 43 always shall be off the stop 41, that is the pre-stressing may not be unduly high. However it must be sufficient to prevent the stop 43 of the carrier beam 5 from coming into contact with the stop 25 of the transmission element 27 during weaving operations.

The diameter of the bearing 20 received in the carrier beam 5 is small. As shown by FIG. 4, this bearing 20 is a needle bearing with cylindrical needles 50 mounted in a bearing race 51. The bearing race 51 is pressed into the carrier beam 5. The needles 50 run on the coupling 18 of the torsion spring 16. In another embodiment, the bearing 20 is in the form of a slide bearing lubricated by a lubricating system.

With regard to the use of the apparatus of the invention to sense the warp tension, it would be a drawback if the torsion spring 16 were to touch the inside of the carrier beam 5. The segment 19 of the torsion spring 16 inside the carrier beam 5 being non-rotatable in the area of the screw 46, this particular segment 19 may touch the carrier beam 5 at this location. If the torsion spring 16 were to touch the carrier beam at another location where the carrier beam 5 and the torsion spring 16 are mutually rotating during weaving operations, friction would arise and generate a torque which together with that of the torsion spring 16 would oppose the forces exerted by the warp threads 15 on the carrier beam 5. However, the torsion spring 16 being supported by the bearing 20 and the force F exerting no bending torque in the torsion spring 16, this torsion spring undergoes no bending between the screw 46, by which it is affixed to the carrier beam 5, and the bearing 20. As a result, the spring cannot rub against the carrier beam 5 as well. As a safety measure and particularly in the region of the couplings 52, the diameter of the torsion spring 16 is smaller than the inside diameter of the carrier beam 5.

Even though the transmission element 27 and the element 32 rest in each other and, in addition, the transmission element 27 rests on the coupling 18, a limited bending torque may still be exerted on the torsion spring 16 due to the tolerances between the transmission element 27 and the element 32 and/or between the transmission element 27 and the coupling 18. However this bending torque can be easily absorbed in simple manner by the bearing 20 which is designed as a needle bearing or a slide bearing. As a result, a bending torque in the torsion spring 16 between the bearing 20 and the screw 46 will not result, hence the torsion spring 16 cannot bend and therefore cannot touch the inside diameter of the carrier beam 5.

Logically the stop 25 need not be precisely central relative to the bearing 20. It is enough that the force F exerted by the stop 25 on the bracing element 24 of the force sensor 21 be situated in a radial plane including the bearing 20. With regard to a needle bearing, this means that this force F shall be in the region of the radial planes through the needles 50 of the bearing 20. In such a case the force F generates no bending torque. Regarding the inner stresses within the bearing 20 and the resulting wear, the force F advantageously will be aligned centrally with the needles 50. Similar considerations also apply to stops 41 and 43.

A brace 47 is mounted to the support post 1 and is fitted with a bolt 48 opposite the element 32 to prevent this element 32 from separating from the coupling 18. The force F sensed by the force sensor 21 depends only on the tension of the warp threads 15, and this force sensor can be calibrated in a simple manner as a function of the detected tension of the warp threads 15. A calibrated tensometer may be used, for instance like one described in U.S. Pat. No. 5,029,616, to measure the tension in the warp threads 15.

Figure 8:
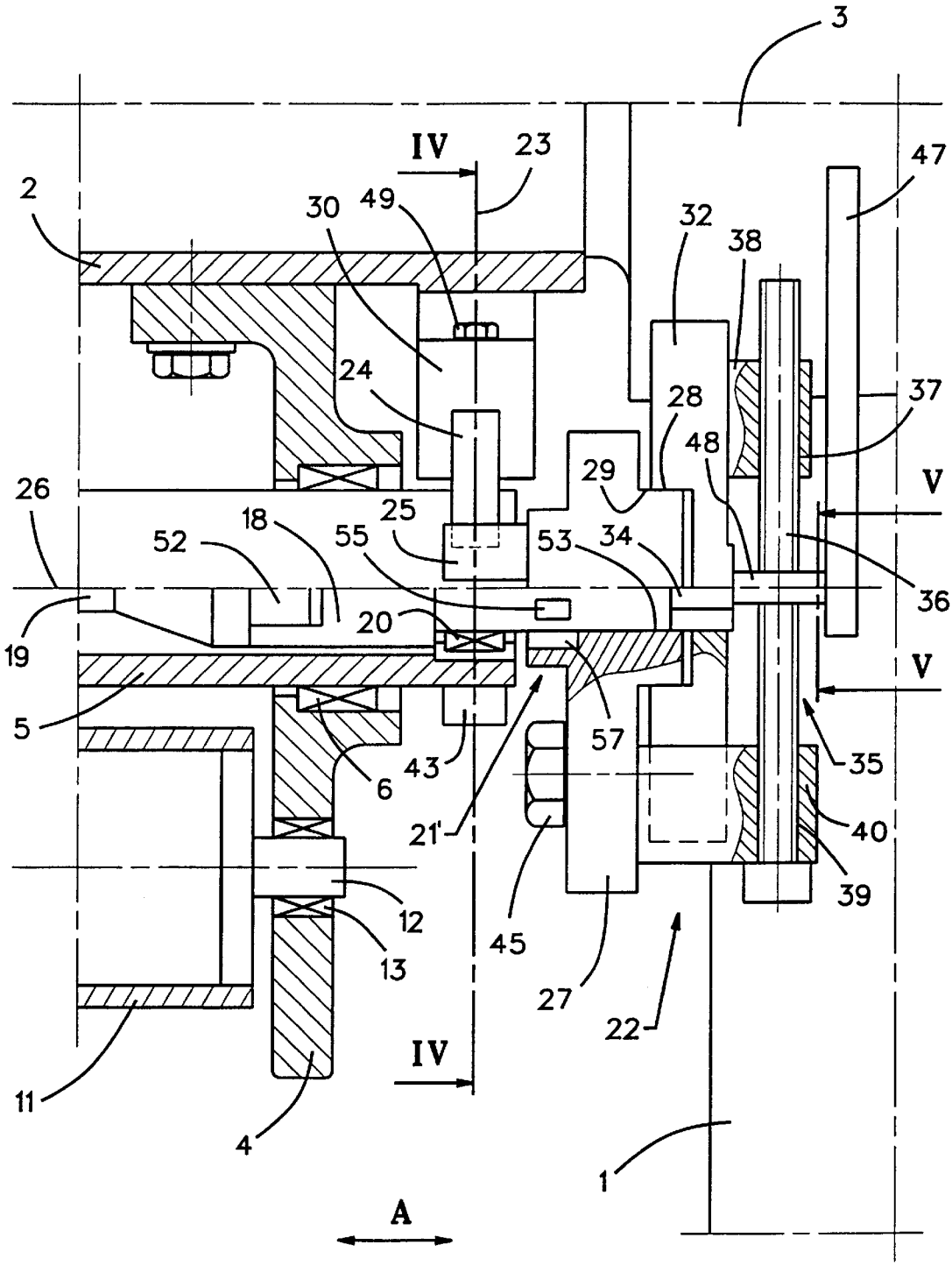
FIG. 8 is a section similar to FIG. 3 of another embodiment.

The principle underlying the design of the embodiment of FIG. 8 corresponds substantially to that of the previously discussed embodiment. It differs however with respect to the force sensor 21'. In this embodiment the coupling 18 of the torsion spring is used as the force sensor 21'. For that purpose the coupling 18 is fitted with bonded strain gauge strips 55 integrated into an impedance bridge (not shown). A clearance 57 is provided in the transmission element 27 in the region of the strain gauges 55. The torque generated by the torsion spring 16, therefore is detected as a deformation of the coupling 18 in the vicinity of its outside surface, not as the deformation of the retention device 30. The retention device 30 and its support element 24—which are mounted outside the carrier beam 5 in the vicinity of the bearing 20—in this embodiment merely absorb the force F opposing the torque of the torsion spring 16. Because the torsion spring 16 is shielded from bending by the force F due to the configuration of the support element 24, the measurement of the torque in the vicinity of the coupling 18 remains unaffected by bending deformations. In this embodiment the strain gauges 55 are mounted in the vicinity of the bearing 20 on the coupling 18, namely between the bearing 20 and the borehole 53 of the transmission element 27. The transmission element 27 together with this bearing 20 rests on the coupling 18.

Logically the force sensor 21 or 21' need not always use strain gauges to measure the force. Illustratively, in embodiments not illustrated, piezoelectric sensors are used as the sensors, and that generate a voltage corresponding to the force acting on the particular sensors.

In another embodiment, the carrier beam 5 is without a tensioning roll 10. In this design the carrier beam 5 is fitted for instance with a cam acting on a bracing element resting in a frame and on which is mounted a tensioning roll 10. Such a design is known, for instance, from the European patent document A 694,638 or U.S. Pat. No. 5,562,128 and is shown by reference elements 28, 29, 19 and 21 in FIG. 1 of these documents. In a further embodiment (not shown), the carrier beam may be fitted with a crank cooperating by a crankrod with a bracing element resting in a frame, with a tensioning roll, for instance, then being mounted on said frame. In the tubular carrier beam 5 of the invention, the torsion spring 16 is mounted inside and by the carrier beam 5 acts on the tensioning roll 10. The tensioning roll 10 is pressed, by the force F generated by the torsion spring 16 and the produced torque, against the warp threads 15.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. An apparatus for tensioning warp threads in a weaving machine, comprising:

a torsion spring;

a tensioning device operating on warp threads and loaded by the torsion spring;

a rotatably supported carrier beam acting at a distance from its axis of rotation on the tensioning device; and a sensing device that senses torsional moments of the torsion spring.

2. The apparatus as claimed in claim 1, wherein the sensing device comprises a stationary stop, the sensing device is adapted to sense torque of the torsion spring, an end of the torsion spring is mounted inside the carrier beam and supported inside the carrier beam by a bearing, the torsion spring is connectable to a measuring device substantially in a radial plane of the bearing.

3. The apparatus as claimed in claim 2, wherein the measuring device is configured around the carrier beam and is substantially situated in a radial plane running perpendicularly to the longitudinal axis of the carrier beam in a region of the bearing.

4. The apparatus as claimed in claim 2, further comprising a transmission element which is rotatably supported concentrically with an axis of rotation of the torsion spring.

5. The apparatus as claimed in claim 2, wherein a rotational displacement of the carrier beam towards the warp threads is limited by stops.

6. The apparatus as claimed in claim 5, wherein the stops are positioned at least approximately in the radial plane of the bearing of the torsion spring.

7. The apparatus as claimed in claim 1, wherein the sensing device comprises a stationary stop, the torsion spring is connectable to a measuring device substantially in a radial plane of the bearing.

8. The apparatus as claimed in claim 7, wherein the sensing device comprises a stationary stop, an end of the torsion spring is mounted inside the carrier beam and is supported inside the carrier by a bearing, and the stationary stop is at least approximately situated in a radial plane of the bearing.

9. The apparatus as claimed in claim 7, wherein the sensing device comprises a force sensor that is integrated into the stationary stop or a retention device.

10. The apparatus as claimed in claim 7, wherein the torsion spring is connected to the measuring device by a coupling into which is integrated a force sensor.

11. The apparatus as claimed in claim 7, wherein the measuring device comprises an element non-rotationally connected to the torsion spring and linked by an adjusting element to a transmission element resting against the stationary stop.

12. The apparatus as claimed in claim 1, wherein an end of the torsion spring is mounted inside the carrier beam and supported inside the carrier beam by a needle bearing.

13. The apparatus as claimed in claim 1, wherein the torsion spring comprises several mutually non-rotational segments which are axially and relatively displaceable and which are connectable to the carrier beam via a coupling.

14. The apparatus as claimed in claim 1, wherein the torsion spring is pre-stressed.

* * * * *